US007817139B2

(12) United States Patent
Iso

(10) Patent No.: US 7,817,139 B2
(45) Date of Patent: Oct. 19, 2010

(54) MEMBRANE SWITCH, KEYBOARD, AND ELECTRONIC APPARATUS HAVING KEYBOARD

(75) Inventor: Kageyuki Iso, Akishima (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 831 days.

(21) Appl. No.: 11/801,857

(22) Filed: May 10, 2007

(65) Prior Publication Data

US 2007/0278083 A1 Dec. 6, 2007

(30) Foreign Application Priority Data

May 31, 2006 (JP) ..... 2006-151671

(51) Int. Cl.
*G09G 5/00* (2006.01)

(52) U.S. Cl. ..... 345/168; 345/156; 200/512

(58) Field of Classification Search ..... 345/156–173; 200/512

See application file for complete search history.

(56) References Cited

U.S. PATENT DOCUMENTS

| | | | | |
|---|---|---|---|---|
| 6,072,133 | A * | 6/2000 | Takagi et al. | 200/344 |
| 6,355,894 | B2 * | 3/2002 | Miyakoshi | 200/344 |
| 6,392,179 | B1 * | 5/2002 | Schwarzbich | 200/520 |
| 6,831,241 | B2 * | 12/2004 | Fukui et al. | 200/512 |
| 6,861,961 | B2 * | 3/2005 | Sandbach et al. | 341/22 |
| 6,946,611 | B2 * | 9/2005 | Yoneyama | 200/515 |
| 6,995,324 | B2 * | 2/2006 | Asada | 200/1 B |
| 2001/0011999 | A1 * | 8/2001 | Mochizuki | 345/168 |
| 2001/0023818 | A1 * | 9/2001 | Masaru et al. | 200/512 |
| 2002/0125118 | A1 * | 9/2002 | Douzono et al. | 200/314 |
| 2003/0179540 | A1 | 9/2003 | Suda | |
| 2004/0118665 | A1 * | 6/2004 | Ito | 200/5 A |
| 2004/0129549 | A1 * | 7/2004 | Serizawa et al. | 200/513 |
| 2005/0000789 | A1 * | 1/2005 | Yoneyama | 200/512 |
| 2007/0246396 | A1 * | 10/2007 | Brollier | 206/534 |
| 2008/0029377 | A1 * | 2/2008 | Tsuduki | 200/533 |
| 2009/0091478 | A1 * | 4/2009 | Chan et al. | 341/22 |

FOREIGN PATENT DOCUMENTS

| | | |
|---|---|---|
| CN | 2105752 | 5/1992 |
| JP | 05-234459 | 9/1993 |
| JP | 09-259693 | 10/1997 |

OTHER PUBLICATIONS

Chinese Office Action dated Jan. 9, 2009 for application No. 200710109210.4 (U.S. Appl. No. 11/801,857), entitled Membrane switch keyboard, and electronic apparatus having keyboard.

* cited by examiner

*Primary Examiner*—Nitin Patel
(74) *Attorney, Agent, or Firm*—Blakely, Sokoloff, Taylor & Zafman LLP

(57) ABSTRACT

According to one embodiment, a membrane switch includes an insulating sheet provided with a first sheet portion having a first contact, a second sheet portion having a second contact, and a fold-back portion having a fold line. The fold-back portion has a conductor pattern which crosses the fold line. A gap in which the conductor pattern is to be situated is defined inside the fold-back portion by folding the fold-back portion of the insulating sheet along the fold line so that the first contact and the second contact face each other. The gap is filled with an adhesive having electrical insulating properties and water-repellent properties. The adhesive covers the conductor pattern.

12 Claims, 5 Drawing Sheets

MEMBRANE SWITCH, KEYBOARD, AND ELECTRONIC APPARATUS HAVING KEYBOARD

CROSS-REFERENCE TO RELATED APPLICATIONS

This application is based upon and claims the benefit of priority from Japanese Patent Application No. 2006-151671, filed May 31, 2006, the entire contents of which are incorporated herein by reference.

BACKGROUND

1. Field

One embodiment of the invention relates to a membrane switch having a flexible insulating sheet to be folded when it is used, and more specifically, to a structure for enhancing the waterproof performance of a fold-back portion of the insulating sheet. Further, the present invention relates to a keyboard in which depression of keytops is electrically detected by using the membrane switch and an electronic apparatus, such as a portable computer, having the keyboard.

2. Description of the Related Art

A keyboard used in, for example, a portable computer comprises keytops and a membrane switch. The membrane switch, which serves electrically to detect depression of each keytop, has fixed contacts and movable contacts. The fixed and movable contacts face one another across a space in positions corresponding to the keytops, individually.

A membrane switch is described in Jpn. Pat. Appln. KOKAI Publication No. 9-259693, for example. It has a flexible insulating sheet on which fixed contacts and movable contacts are printed. In this membrane switch, the fixed and movable contacts are printed on one surface of the insulating sheet. The insulating sheet is folded so that the fixed and movable contacts face one another.

According to the membrane switch of this fold type, the insulating sheet is provided with a first sheet portion on which the fixed contacts are printed, a second sheet portion on which the movable contacts are printed, and a fold-back portion situated between the first and second sheet portions.

The first and second sheet portions are located symmetrically with respect to the fold-back portion. A plurality of conductor patterns are printed on the fold-back portion. The conductor patterns cross the fold-back portion so as to span the boundary between the first and second sheet portions. The fold-back portion is folded in a U shape such that the first and second sheet portions face each other. Thus, a gap is defined inside the fold-back portion, and the conductor patterns are situated in the gap.

According to the conventional folded membrane switch, the fold-back portion of the insulating sheet is bent with a relatively large amount of curvature in order to reduce the thickness of the switch. Thus, a stress easily acts on the fold-back portion of the insulating sheet, so that fine cracks may possibly develop in the fold-back portion after prolonged use.

Depending on the working environment of the keyboard, therefore, water inevitably runs along the cracks and gets into the space inside the fold-back portion. The water confined in the gap will cause migration in the conductor patterns that are situated in the gap.

To cope with this, in the membrane switch disclosed in Jpn. Pat. Appln. KOKAI Publication No. 9-259693 mentioned before, a waterproof protective film is bonded to the fold-back portion of the insulating sheet with an adhesive agent. The adhesive agent is disposed along the outer peripheral edge portion of the protective film, and most of it is situated off the conductor patterns. The protective film covers the conductor patterns from the opposite side of the insulating sheet, thereby enhancing the waterproof performance of the conductor patterns.

According to the membrane switch disclosed in the patent document described above, however, the protective film must be bonded very carefully and elaborately so that the adhesive agent entirely fills the space between the film and the insulating sheet. Thus, operation for bonding the protective film requires a lot of time, as well as much labor and skill.

When the protective film is bonded to the insulating sheet, moreover, it conceals the adhesive agent, so that it is difficult to determine whether or not the adhesion of the film is satisfactory. In consequence, the state of adhesion of the protective film sometimes may vary according to products, possibly lowering the reliability of the membrane switch in waterproof performance.

BRIEF DESCRIPTION OF THE SEVERAL VIEWS OF THE DRAWINGS

A general architecture that implements the various feature of the invention will now be described with reference to the drawings. The drawings and the associated descriptions are provided to illustrate embodiments of the invention and not limit the scope of the invention.

DETAILED DESCRIPTION

Various embodiments according to the invention will be described hereinafter with reference to the accompanying drawings. In general, according to one embodiment of the invention, a membrane switch comprises an insulating sheet including a first sheet portion having a first contact, a second sheet portion having a second contact, and a fold-back portion situated between the first and second sheet portions. The fold-back portion has a fold line which extends across a direction of arrangement of the first and second sheet portions and a conductor pattern which spans a boundary between the first and second sheet portions so as to cross the fold line. When the fold-back portion is folded along the fold line, the first and second contacts face each other, and the conductor pattern is situated in a gap defined inside the fold-back portion. The gap inside the fold-back portion is filled with an adhesive. The adhesive has electrical insulating properties and water-repellent properties and covers the conductor pattern.

Figure 1:
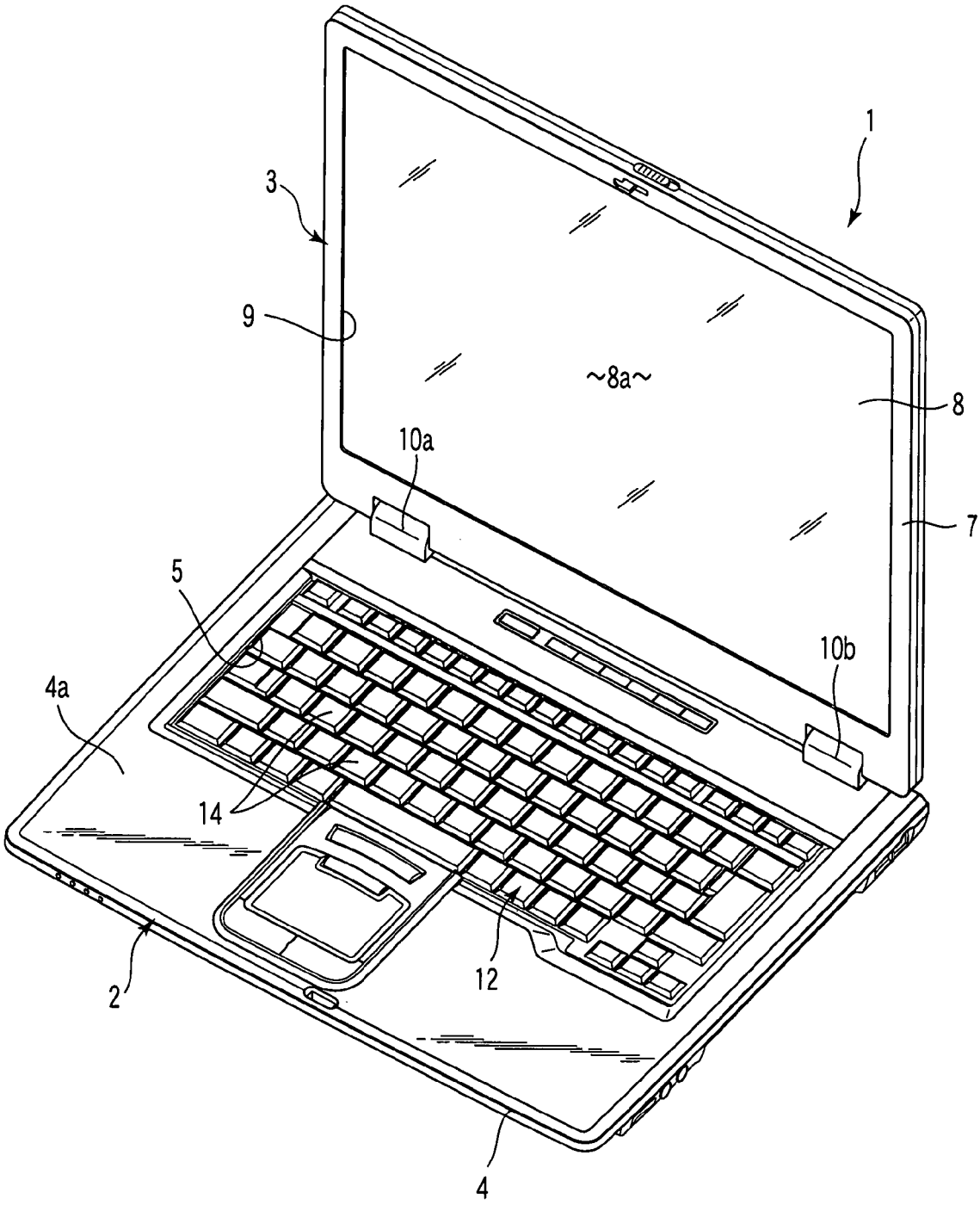
FIG. 1 is a perspective view of an exemplary portable computer according to an embodiment of the invention.
Figure 2:
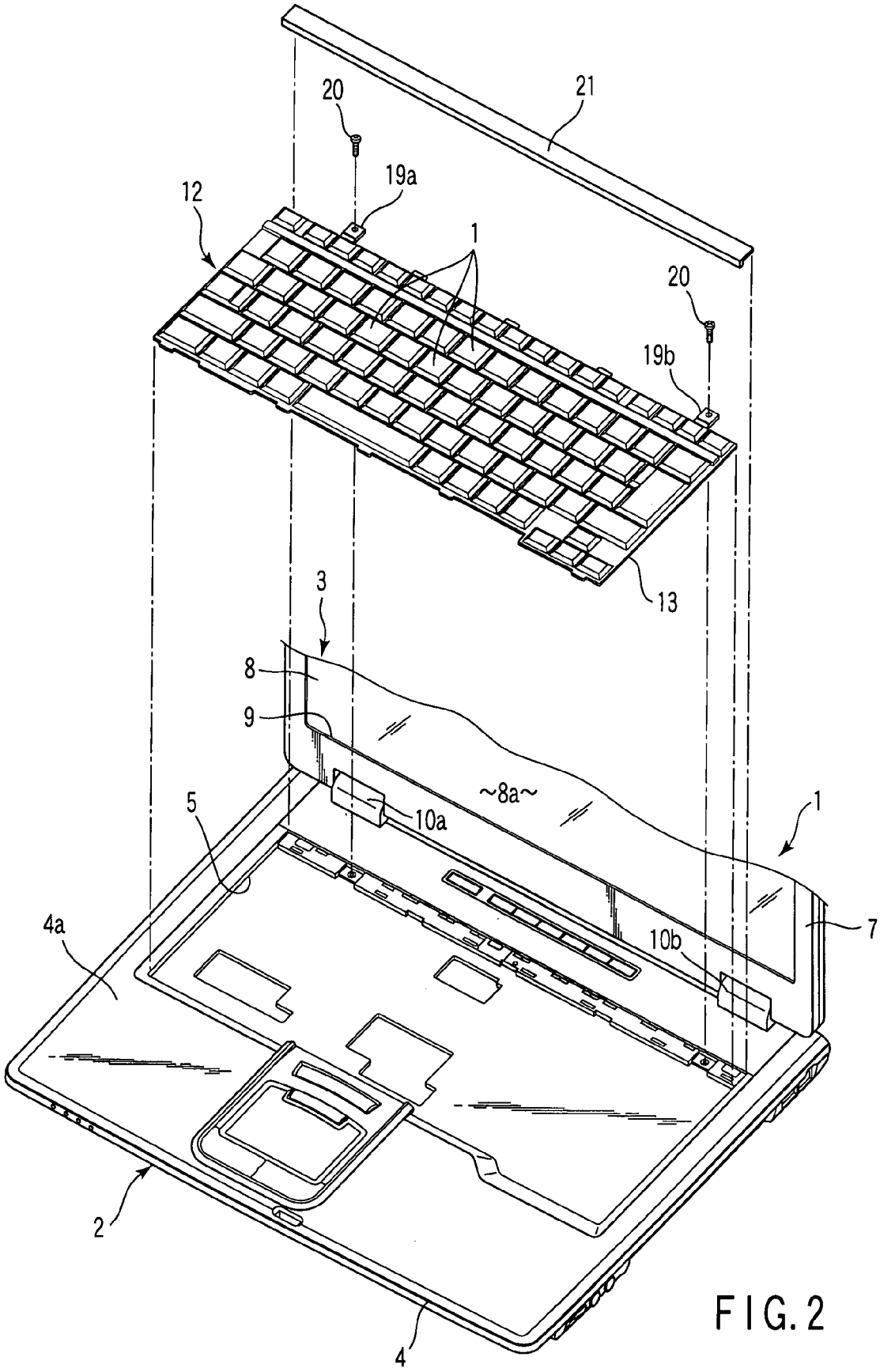
FIG. 2 is an exemplary perspective view of the portable computer according to the embodiment of the invention with its keyboard disengaged from its housing.

FIGS. 1 and 2 show a portable computer 1 as an example of an electronic apparatus. The portable computer 1 comprises a main unit 2 and a display unit 3. The main unit 2 has a first housing 4 in the form of a flat box. The first housing 4 contains principal components, such as a printed wiring board mounted with a CPU and a hard disc drive. The first housing 4 has a flat top surface 4*a*. A keyboard mounting portion 5 is formed in the central part of the top surface 4*a*.

The display unit 3 is provided with a second housing 7 in the form of a flat box and a liquid crystal display panel 8 in the housing 7. The display panel 8 has a screen 8*a*. The screen 8*a* is exposed to the outside of the display unit 3 through an opening 9 that opens in the front face of the second housing 7.

The display unit 3 is supported by a pair of hinge portions 10*a* and 10*b* that protrude from the rear end portion of the first housing 4. It is swingable between a closed position and an open position. In the closed position, the display unit 3 lies flat on the main unit 2. In the open position, it rises from the rear end portion of the main unit 2.

Figure 3:
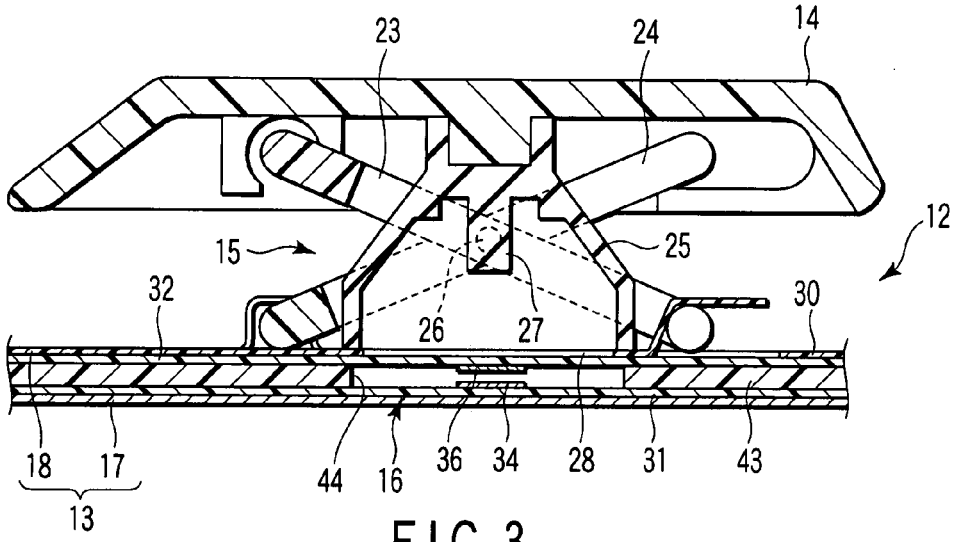
FIG. 3 is an exemplary sectional view of the keyboard according to the embodiment of the invention.

A keyboard 12 is fixed to the keyboard mounting portion 5 of the first housing 4. As shown in FIG. 3, the keyboard 12 is provided with a keyboard base 13, keytops 14, pantographic keytop supporting portions 15, and a folded membrane switch 16.

The keyboard base 13 is in the form of a flat plate that can be fitted in the keyboard mounting portion 5. It has a lower frame 17 and an upper frame 18. The lower and upper frames 17 and 18 are laminated together.

The front end edge of the keyboard base 13 is caught by the keyboard mounting portion 5. The rear end edge of the keyboard base 13 has a pair of lugs 19*a* and 19*b* that project behind the base 13. The lugs 19*a* and 19*b* are fixed to the keyboard mounting portion 5 by screws 20, individually. The lugs 19*a* and 19*b* and the screws 20 are concealed by a belt-shaped cover 21.

The keytops 14 are arranged in a matrix on the keyboard base 13. Each keytop 14 has a size such that it can be depressed by a fingertip.

As shown in FIG. 3, each keytop supporting portion 15 is interposed between each keytop 14 and the upper frame 18 of the keyboard base 13. The keytop supporting portion 15 is provided with a first link lever 23, a second link lever 24, and a rubber spring 25.

The first and second link levers 23 and 24 are crossed in an X shape and are rotatably coupled to each other at their intersection by a pivot 26. The upper end of the first link lever 23 is rockably supported by the front part of the lower surface of the upper frame 18. The lower end of the first link lever 23 is slidably supported by the upper surface of the upper frame 18. Likewise, the upper end of the second link lever 24 is slidably supported by the rear part of the lower surface of the keytop 14. The lower end of the second link lever 24 is rockably supported by the upper surface of the upper frame 18. Thus, the first and second link levers 23 and 24 are rockable around the pivot 26 and support the keytop 14 on the keyboard base 13 for up-and-down motion.

In other words, the keytop 14 is designed for vertical stokes between a standby position where it is pushed up above the keyboard base 13 and a depressed position where it is sunk to extend along the keyboard base 13.

The rubber spring 25 is interposed between the lower surface of the keytop 14 and the upper frame 18. It is in the form of a cup or dome that opens toward the upper frame 18. The spring 25 continually pushes up the keytop 14 toward the standby position. It has a pressing protrusion 27 that protrudes downward from its upper end portion. The protrusion 27 faces a through hole 28 in the upper frame 18.

Figure 5:
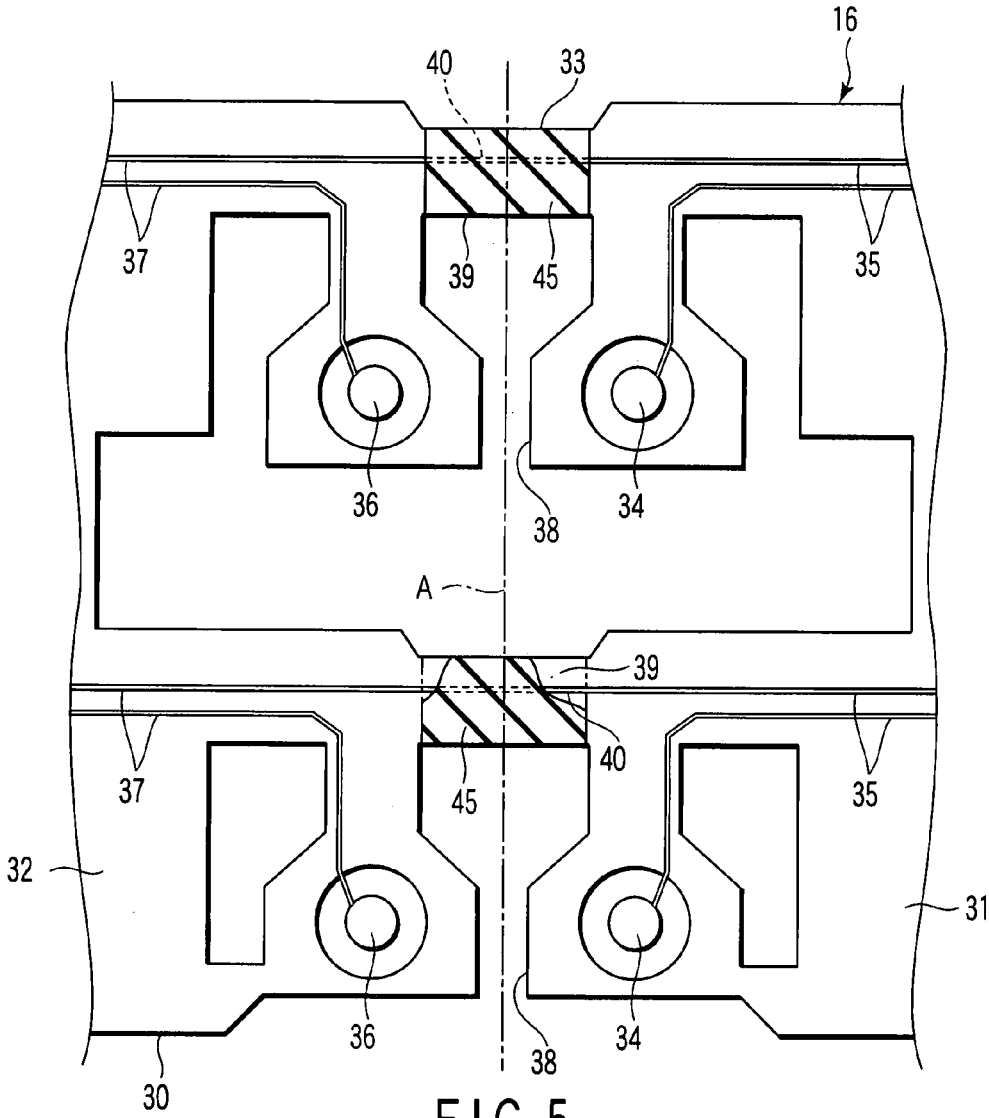
FIG. 5 is an exemplary plan view of the membrane switch showing the positional relationship between first and second sheet portions and a fold-back portion of an insulating sheet in an unfolded state according to the embodiment of the invention.
Figure 4:
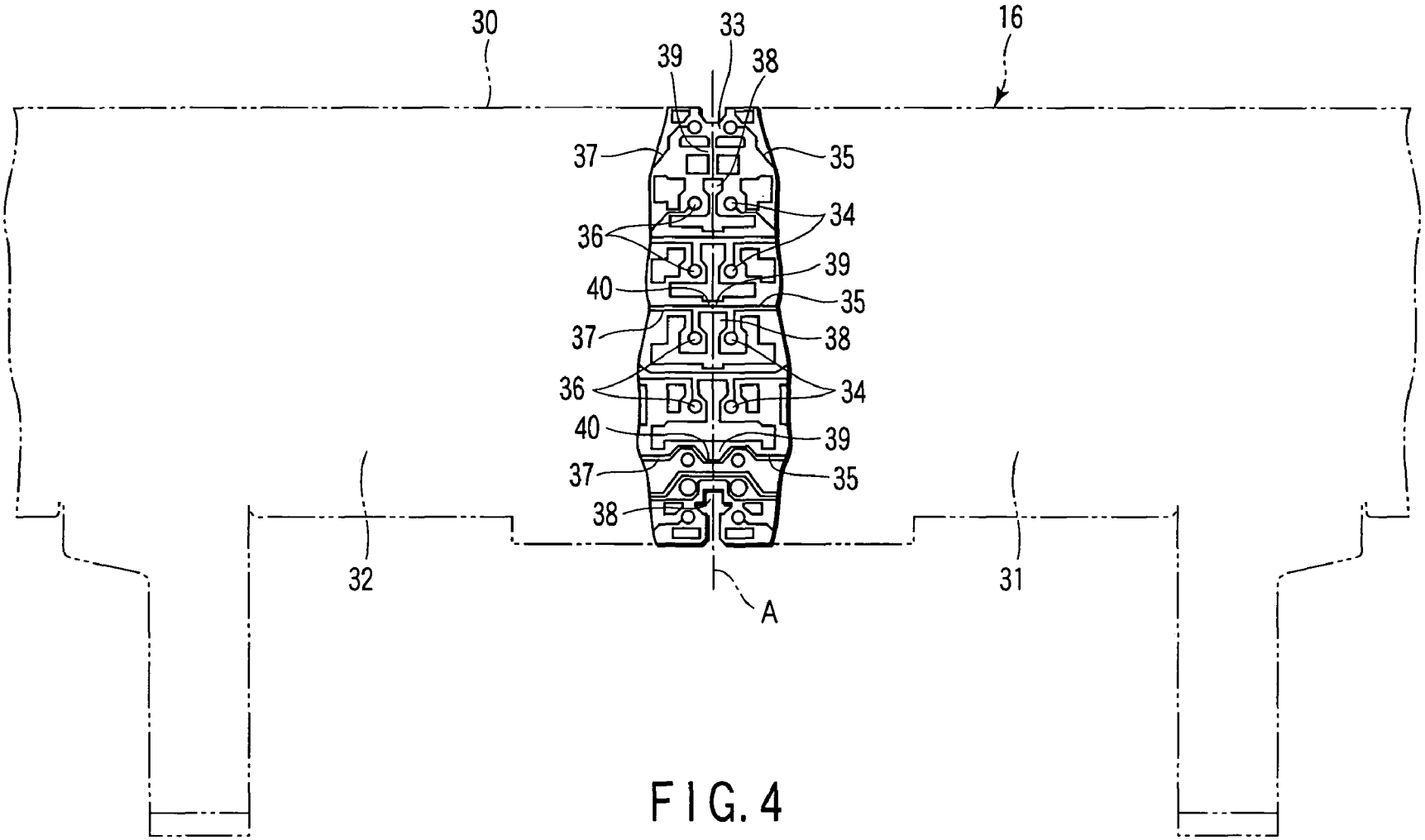
FIG. 4 is an exemplary plan view of a membrane switch for the keyboard according to the embodiment of the invention.
Figure 6:
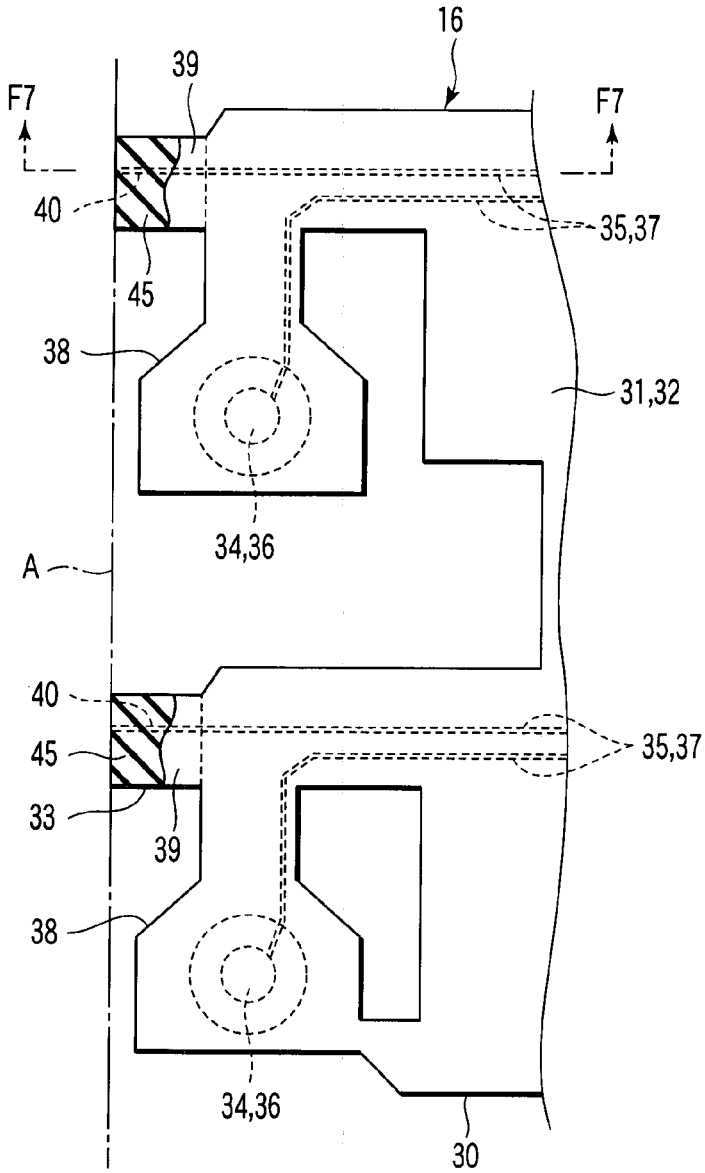
FIG. 6 is an exemplary plan view of the membrane switch, partially in section, showing the insulating sheet in a folded state according to the embodiment of the invention.

The membrane switch 16, which serves electrically to detect depression of the keytop 14, is located between the lower and upper frames 17 and 18. As shown in FIGS. 4 to 6, the switch 16 has one insulating sheet 30. The insulating sheet 30 is formed of a plastic material, such as polyethylene terephthalate, and has flexibility.

The insulating sheet 30 is provided integrally with a first sheet portion 31, a second sheet portion 32, and a fold-back portion 33. The first and second sheet portions 31 and 32 have the same shape. Fixed contacts 34. and conductor patterns 35 are printed on one surface of the first sheet portion 31. Each fixed contact 34 is an example of a first contact. The fixed contacts 34 are arranged in a matrix on the one surface of the first sheet portion 31 so as to correspond to the array of the keytops 14.

Moveable contacts 36 and conductor patterns 37 are printed on one surface of the second sheet portion 32. Each movable contact 36 is an example of a second contact. The movable contacts 36 are arranged in a matrix on the one surface of the second sheet portion 32 so as to correspond to the array of the keytops 14.

The fold-back portion 33 is situated between the first and second sheet portions 31 and 32 and connect these sheet portions. The fold-back portion 33 has a straight fold line A. The fold line A extends at right angles to the direction of arrangement of the first and second sheet portions 31 and 32 so as to divide them. Thus, the first sheet portion 31 that has the fixed contacts 34 and the second sheet portion 32 that has the movable contacts 36 are arranged so as to be axially symmetrical with respect to the fold line A.

The fold-back portion 33 has apertures 38 and bridge portions 39. The apertures 38 are situated on the fold line A and spaced from one another in the length direction of the fold line A.

The bridge portions 39 adjoin their corresponding apertures 38 and span the boundary between the first and second sheet portions 31 and 32. A conductor pattern 40 is printed on one side of each bridge portion 39. It crosses the fold line A. The conductor pattern 40 electrically connects a desired one of the conductor patterns 35 on the first sheet portion 31 and a desired one of the conductor patterns 37 on the second sheet portion 32.

Figure 7:
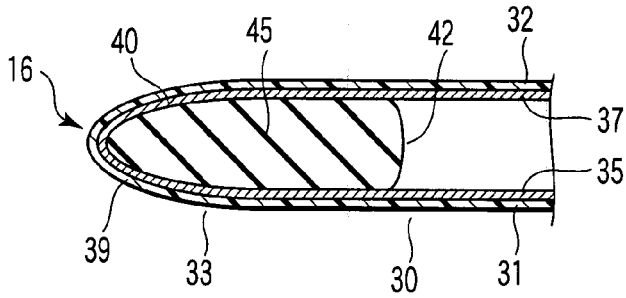
FIG. 7 is an exemplary sectional view taken along line F7-F7 of FIG. 6.

As shown in FIGS. 6 and 7, the insulating sheet 30 is folded 180 degrees around the fold line A so that the second sheet portion 32 is situated on the first sheet portion 31. This folding makes the fixed contacts 34 and the movable contacts 36 face one another across a space. As shown in FIG. 7, moreover, each bridge portion 39 of the fold-back portion 33 is folded in a U shape to form a gap 42 inside itself.

In other words, the fold-back portion 33 is bent in a U shape such that one surface of each bridge portion 39 on which the conductor pattern 40 is situated faces inward. Thus, the conductor pattern 40 faces the gap 42.

In folding the insulating sheet 30 at the fold-back portion 33, an insulating spacer 43 such as the one shown in FIG. 3 is sandwiched between the first and second sheet portions 31 and 32. The spacer 43 has an aperture 44 in a position corresponding to the fixed and movable contacts 34 and 36, whereby the contacts 34 and 36 can be disposed without interference.

The insulating spacer 43 serves to keep the space between the fixed and movable contacts 34 and 36 fixed. As shown in FIG. 3, the contacts 34 and 36 that face one another are situated right under the pressing protrusion 27 of each keytop 14.

In the present embodiment, an adhesive 45 is applied to the one surface of each bridge portion 39 before the fold-back portion 33 of the insulating sheet 30 is folded. The adhesive 45 consists mainly of, for example, silicone and is of a type dedicated to use in electric components. The adhesive 45 of this type has electrical insulating properties and water-repellent properties and is high in heat resistance and volatility. The adhesive 45 directly covers the conductor pattern 40 that is located on the one surface of the bridge portion 39.

When the bridge portion 39 is folded along the fold line A, the gap 42 inside it is loaded with the adhesive 45, as shown in FIG. 7. In consequence, the adhesive 45 completely fills up the gap 42. As the adhesive 45 is cured, moreover, the bridge portion 39 is kept folded in a U shape.

If one of the keytops 14 of the keyboard 12 is depressed from the standby position toward the depressed position by a fingertip, the first and second link levers 23 and 24 rock downward against the urging force of the rubber spring 25. As this is done, the spring 25 is compressed so that its pressing protrusion 27 moves downward.

Thereupon, that part of the second sheet portion 32 which corresponds to each movable contact 36 is pressed downward by the pressing protrusion 27. In consequence, the movable contact 36 is pressed against the fixed contact 34, whereupon the membrane switch 16 is closed.

If the keytop 14 is released from depression, it is pushed up from the depressed position to the standby position by the urging force of the rubber spring 25. Thereupon, the pressing protrusion 27 of the spring 25 is disengaged from the second sheet portion 32. At the same time, the second sheet portion 32 is restored to its original shape by its own resilience, so that the movable contact 36 is disengaged from the fixed contact 34. Thereupon, the membrane switch 16 is opened. Thus, the switch 16 is worked by the keytop 14.

According to this embodiment of the invention, the electrically insulating, water-repellent adhesive 45 is applied to the one surface of each bridge portion 39 before the fold-back portion 33 of the insulating sheet 30 is folded back. The adhesive 45 directly covers the conductor pattern 40 that is printed on the one surface of the bridge portion 39.

Accordingly, whether or not the adhesive 45 is securely applied to each bridge portion 39 can be easily identified by visual observation. Thus, the adhesive 45 can be applied with good operating efficiency.

When the fold-back portion 33 is folded along the fold line A, moreover, the adhesive 45 fills up the gap 42 that is defined inside each bridge portion 39. Thus, the conductor pattern 40 in the gap 42 can be entirely covered by the adhesive 45.

In consequence, if water gets into the gap 42 through cracks in the bridge portion 39 that may be created after prolonged use of the membrane switch 16, for example, it is repelled by the adhesive 45 and can never reach the conductor pattern 40.

Accordingly, the conductor pattern 40 can enjoy satisfactory waterproof performance, so that migration cannot easily occur in the pattern 40. Thus, the fold-back portion 33 of the membrane switch 16 is improved in weather resistance and migration resistance, so that the waterproof performance of the switch 16 is enhanced.

Once the adhesive 45 is cured, moreover, it can maintain the U shape of the folded fold-back portion 33. Therefore, deformation of the conductor pattern 40 can be restrained by utilizing the adhesive 45. Thus, the conductor pattern 40 can avoid being subjected to an undue force, so that its breakage can be prevented securely.

According to the embodiment described above, furthermore, the fold-back portion 33 of the insulating sheet 30 has the apertures 38 that are situated on the fold line A. In other words, the apertures 38 serve to divide the fold-back portion 33 into the bridge portions 39 that are arranged at spaces in the length direction of the fold line A, so that the area of the fold-back portion 33 is substantially reduced.

Thus, only a small resistance is encountered when the fold-back portion 33 is folded along the fold line A, so that the fold-back portion 33 can be easily folded with a small force. When the insulating sheet 30 is folded back, therefore, an undue force cannot easily act on the conductor pattern 40. This also serves for the prevention of breakage of the conductor pattern 40.

The membrane switch according to the present invention is not limited to use in a keyboard but may be also practically used as any of various touch switches, for example.

While certain embodiments of the inventions have been described, these embodiments have been presented by way of example only, and are not intended to limit the scope of the inventions. Indeed, the novel methods and systems described herein may be embodied in a variety of other forms; furthermore, various omissions, substitutions and changes in the form of the methods and systems described herein may be made without departing from the spirit of the inventions. The accompanying claims and their equivalents are intended to cover such forms or modifications as would fall within the scope and sprit of the inventions.

What is claimed is:

1. A membrane switch comprising:

an insulating sheet including a first sheet portion having a first contact, a second sheet portion having a second contact, and a fold-back portion situated between the first sheet portion and the second sheet portion, the fold-back portion having a fold line which extends across a direction of arrangement of the first sheet portion and the second sheet portion and a conductor pattern which spans a boundary between the first sheet portion and the second sheet portion so as to cross the fold line, whereby the first contact and the second contact face each other and the conductor pattern is situated in a gap defined inside the fold-back portion when the fold-back portion is folded along the fold line; and an adhesive filled in the gap inside the fold-back portion, the adhesive having electrical insulating properties and water-repellent properties and covering the conductor pattern.

2. A membrane switch according to claim 1, wherein the adhesive keeps the fold-back portion of the insulating sheet in a folded shape.

3. A membrane switch according to claim 1, wherein the adhesive is applied to the fold-back portion of the insulating sheet when the fold-back portion is folded along the fold line.

4. A membrane switch according to claim 3, wherein the fold-back portion of the insulating sheet has a plurality of apertures situated on the fold line and a plurality of bridge portions which span a boundary between the first sheet portion and the second sheet portion, the adhesive being applied to the bridge portions.

5. A membrane switch according to claim 3, wherein the fold-back portion of the insulating sheet has a plurality of bridge portions which span a boundary between the first sheet portion and the second sheet portion, the bridge portions being arranged on the fold line at spaces in a length direction of the fold line, the adhesive being applied to the bridge portions.

6. A keyboard comprising:

a plurality of keytops; and a membrane switch configured to be worked by the keytops, wherein the membrane switch comprises:

(1) an insulating sheet including a first sheet portion having a first contact, a second sheet portion having a second contact, and a fold-back portion situated between the first sheet portion and the second sheet portion, the fold-back portion having a fold line which extends across a direction of arrangement of the first sheet portion and the second sheet portion and a conductor pattern which spans a boundary between the first sheet portion and the second sheet portion so as to cross the fold line, whereby the first contact and the second contact face each other and the conductor pattern is situated in a gap defined inside the fold-back portion when the fold-back portion is folded along the fold line; and (2) an adhesive filled in the gap inside the fold-back portion, the adhesive having electrical insulating properties and water-repellent properties and covering the conductor pattern.

7. A keyboard according to claim 6, wherein the adhesive is applied to the fold-back portion of the insulating sheet when the fold-back portion is folded along the fold line.

8. A keyboard according to claim 6, wherein the fold-back portion of the insulating sheet has a plurality of apertures situated on the fold line and a plurality of bridge portions which span a boundary between the first sheet portion and the second sheet portion, the adhesive being applied to the bridge portions.

9. A keyboard according to claim 6, wherein the fold-back portion of the insulating sheet has a plurality of bridge portions which span a boundary between the first sheet portion and the second sheet portion, the bridge portions being arranged on the fold line at spaces in a length direction of the fold line, the adhesive being applied to the bridge portions.

10. An electronic apparatus comprising:

a housing;

a keyboard supported by the housing and having a plurality of keytops; and a membrane switch configured to be worked by the keytops, the membrane switch comprising (1) an insulating sheet including a first sheet portion having a first contact, a second sheet portion having a second contact, and a fold-back portion situated between the first sheet portion and the second sheet portion, the fold-back portion having a fold line which extends across a direction of arrangement of the first sheet portion and the second sheet portion and a conductor pattern which spans a boundary between the first sheet portion and the second sheet portion so as to cross the fold line, whereby the first contact and the second contact face each other and the conductor pattern is situated in a gap defined inside the fold-back portion when the fold-back portion is folded along the fold line and (2) an adhesive filled in the gap inside the fold-back portion, the adhesive having electrical insulating properties and water-repellent properties and covering the conductor pattern.

11. An electronic apparatus according to claim 10, wherein the adhesive is applied to the fold-back portion of the insulating sheet when the fold-back portion is folded along the fold line.

12. An electronic apparatus according to claim 10, wherein the fold-back portion of the insulating sheet has a plurality of apertures situated on the fold line and a plurality of bridge portions which span a boundary between the first sheet portion and the second sheet portion, the adhesive being applied to the bridge portions.

* * * * *